US009685733B2

(12) United States Patent
Zhao et al.

(10) Patent No.: US 9,685,733 B2
(45) Date of Patent: Jun. 20, 2017

(54) MAGNETIC CONNECTOR ASSEMBLY

(71) Applicant: FOXCONN INTERCONNECT TECHNOLOGY LIMITED, Grand Cayman (KY)

(72) Inventors: Peng-Ye Zhao, Kunshan (CN); Wei-Chung Lin, New Taipei (TW); Wen-Yi Hsieh, New Taipei (TW); Zhi-Hui Zhu, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/007,238

(22) Filed: Jan. 27, 2016

(65) Prior Publication Data

US 2016/0218462 A1 Jul. 28, 2016

(30) Foreign Application Priority Data

Jan. 27, 2015 (CN) ..... 2015 2 0053922 U

(51) Int. Cl.
*H01R 13/62* (2006.01)

(52) U.S. Cl.
CPC ..... *H01R 13/6205* (2013.01)

(58) Field of Classification Search
USPC ..... 439/39, 519, 289, 188, 40
See application file for complete search history.

(56) References Cited

U.S. PATENT DOCUMENTS 3,431,428 A * 3/1969 Van Valer ..... B60H 1/00014 219/202
3,521,216 A * 7/1970 Tolegian ..... H01R 13/6205 439/152
3,808,577 A * 4/1974 Mathauser ..... H01R 13/6205 439/180
3,810,258 A * 5/1974 Mathauser ..... H01R 13/6205 439/246
5,954,520 A * 9/1999 Schmidt ..... B60D 1/64 439/289
6,030,229 A * 2/2000 Tsutsui ..... H01R 13/6205 336/90
6,478,614 B1 * 11/2002 De'Longhi ..... H01R 13/6205 439/139
7,247,046 B1 * 7/2007 Wu ..... H01R 13/6691 439/490

(Continued)

FOREIGN PATENT DOCUMENTS

TW M457992 5/2013

*Primary Examiner* — Alexander Gilman
(74) *Attorney, Agent, or Firm* — Wei Te Chung; Ming Chieh Chang

(57) ABSTRACT

An electrical connector includes an insulative seat, a plurality of terminals fixed to the insulative seat and at least one magnetic element retained in the insulative seat. The insulative seat defines a vertical first mating surface and a mating portion extending forwardly from the first mating surface, the mating portion defines an inclined second mating surface. Each terminal defines a contacting portion disposed in the mating portion and a soldering portion extending outside of the insulative seat. The mating portion defines a shallow recess recessed from the second mating surface, and the contacting portion defines a free end exposed on the shallow recess and locating behind the second mating surface.

19 Claims, 6 Drawing Sheets

(56) References Cited

U.S. PATENT DOCUMENTS

| | | | | |
|---|---|---|---|---|
| 7,306,479 | B1 * | 12/2007 | Wu | H01R 9/034 439/497 |
| 7,311,526 | B2 * | 12/2007 | Rohrbach | H01R 13/6205 439/218 |
| 7,625,212 | B2 * | 12/2009 | Du | H01R 13/6205 439/39 |
| 7,632,134 | B2 * | 12/2009 | Su | H01R 13/44 439/490 |
| 7,775,801 | B2 * | 8/2010 | Shiff | H01R 13/6205 439/39 |
| 8,187,006 | B2 * | 5/2012 | Rudisill | H01R 11/30 362/249.06 |
| 8,241,043 | B1 * | 8/2012 | Lin | H01R 13/6205 439/39 |
| 8,535,088 | B2 * | 9/2013 | Gao | H01R 9/03 439/39 |
| 8,702,316 | B2 * | 4/2014 | DiFonzo | G02B 6/3817 385/53 |
| 9,065,205 | B2 * | 6/2015 | Gao | H01R 13/5808 |
| 9,083,112 | B2 * | 7/2015 | Asai | H01R 13/6205 |
| 9,437,968 | B2 * | 9/2016 | Tada | H01R 13/6205 |
| 2002/0002004 | A1 * | 1/2002 | Akama | H01R 12/62 439/625 |
| 2005/0255719 | A1 * | 11/2005 | Heidlein | H01R 13/6205 439/39 |

* cited by examiner

MAGNETIC CONNECTOR ASSEMBLY

BACKGROUND OF THE INVENTION

1. Field of the Invention

The present invention relates to a magnetic connector assembly, and more particularly to a magnetic connector assembly which is able to be stably mated.

2. Description of the Related Art

U.S. Pat. No. 7,311,526 issued on Dec. 25, 2007, discloses a magnetic connector including a plug and a receptacle relying on magnetic force to maintain contact. The plug and receptacle each defines at least one magnet and a magnetic element for attracting the magnets, which makes the plug can be combined with the receptacle by magnetic attraction so as to achieve the purpose of power supply. However, the mating effect between the plug and receptacle is not very well.

Therefore, an improved magnetic connector assembly is highly desired to meet overcome the requirement.

BRIEF SUMMARY OF THE INVENTION

An object of the present invention is to provide a magnetic connector assembly can ensure better effect of the terminals thereof and avoid disconnection caused by the insulative seat.

In order to achieve above-mentioned object, an electrical connector includes an insulative seat, a plurality of terminals fixed to the insulative seat and at least one magnetic element retained in the insulative seat. The insulative seat defines a vertical first mating surface and a mating portion extending forwardly from the first mating surface, the mating portion defines an inclined second mating surface. Each terminal defines a contacting portion disposed in the mating portion and a soldering portion extending outside of the insulative seat. The mating portion defines a shallow recess recessed from the second mating surface, and the contacting portion defines a free end exposed on the shallow recess and locating behind the second mating surface.

Other objects, advantages and novel features of the invention will become more apparent from the following detailed description of the present embodiment when taken in conjunction with the accompanying drawings.

DESCRIPTION OF PREFERRED EMBODIMENT OF THE INVENTION

Figure 1:
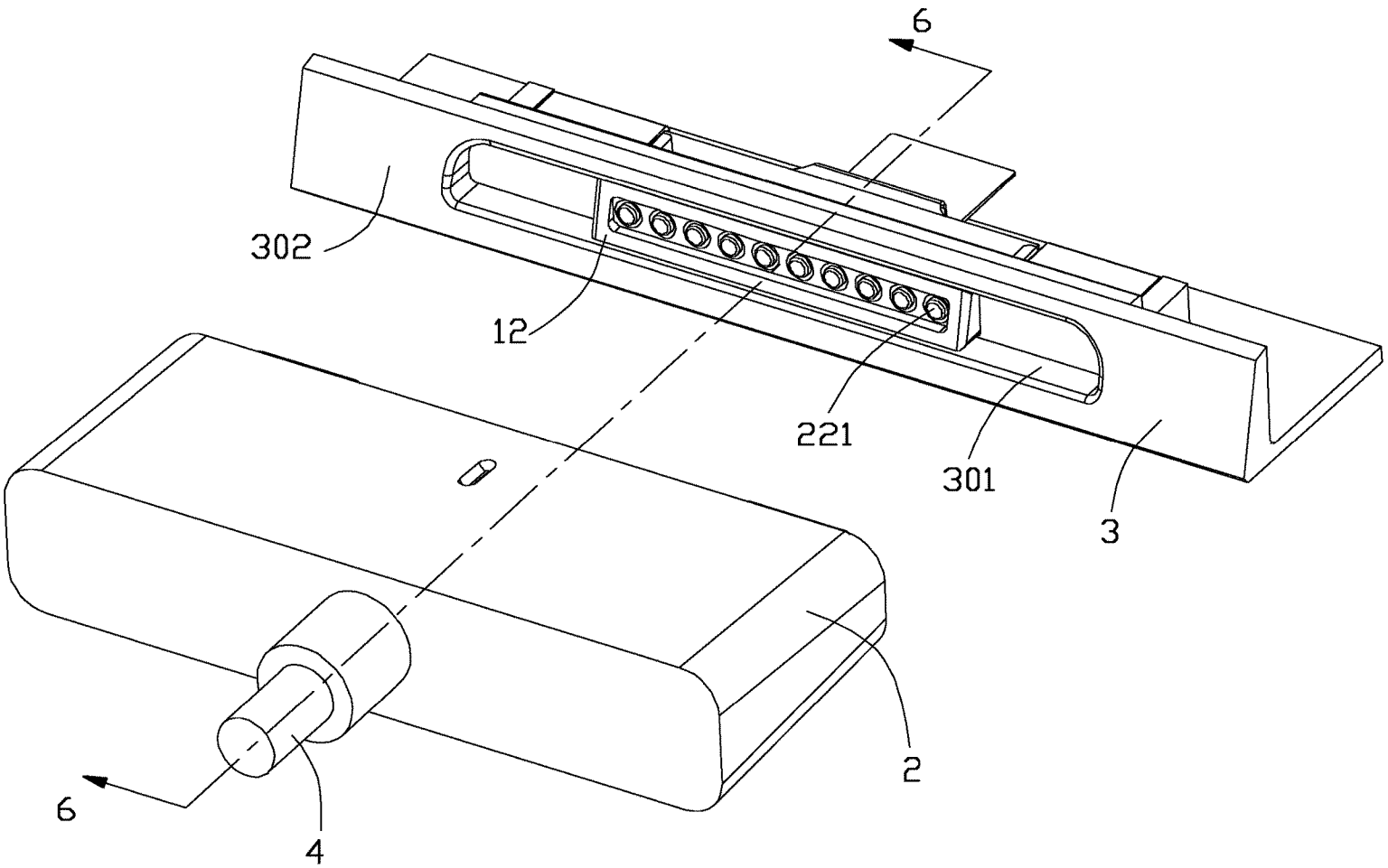
FIG. 1 is a perspective view showing a magnetic connector assembly in accordance with the present invention.
Figure 2:
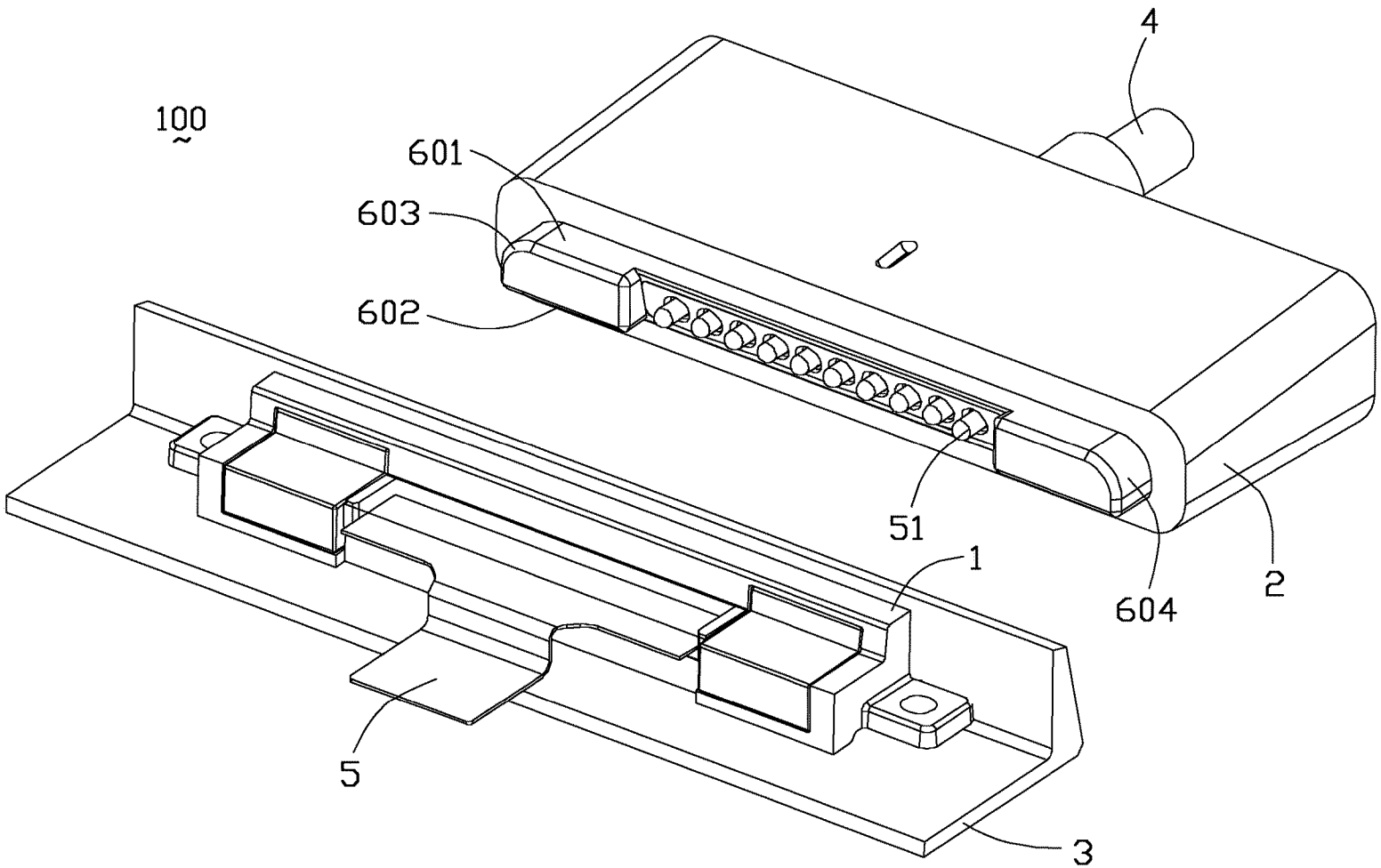
FIG. 2 is another perspective view of the magnetic connector assembly shown in FIG. 1.

Reference will now be made to the drawing figures to describe a preferred embodiment of the present invention in detail. Referring to FIG. 1 and FIG. 2, a magnetic connector assembly is used to achieve power supply. The electrical connector assembly includes an electrical connector 1 used for mounting on a circuit board and a mating connector 2 connected to a cable 4, the electrical connector 1 is usually installed in a device (not shown), such as tablet PCs or laptops. The electrical connector 1 is mounted on a metallic shell 3 of the device and retracted within the outside of the shell 3 so that a receiving cavity 301 is formed between the shell 3 and the electrical connector 1, the receiving cavity 301 defines a foolproof inner wall and is used for exactly the mating connector inserted into, which can achieve the mating function in a single direction.

Figure 3:
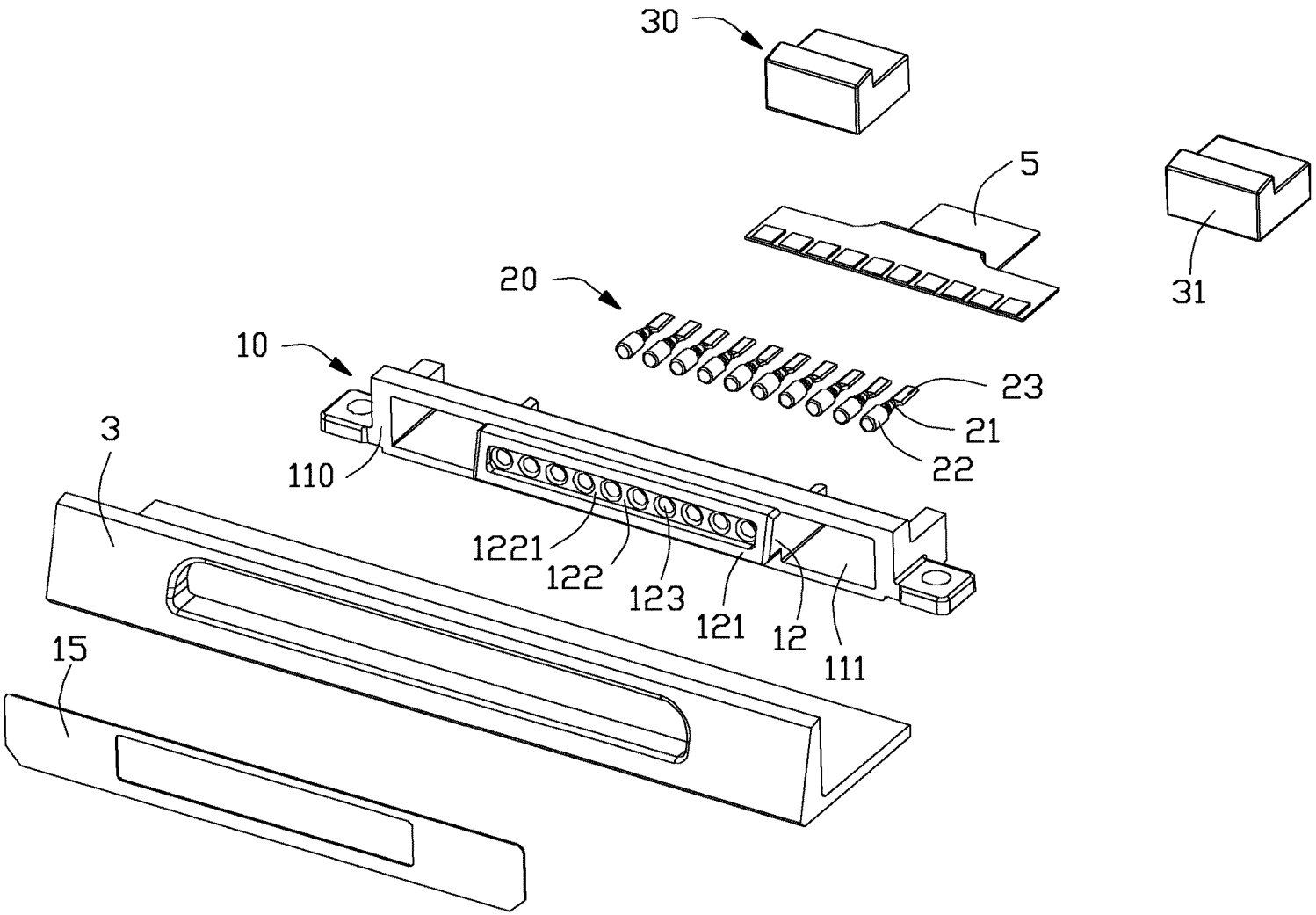
FIG. 3 is an exploded perspective view of an electrical connector of the magnetic connector assembly shown in FIG. 1.
Figure 4:
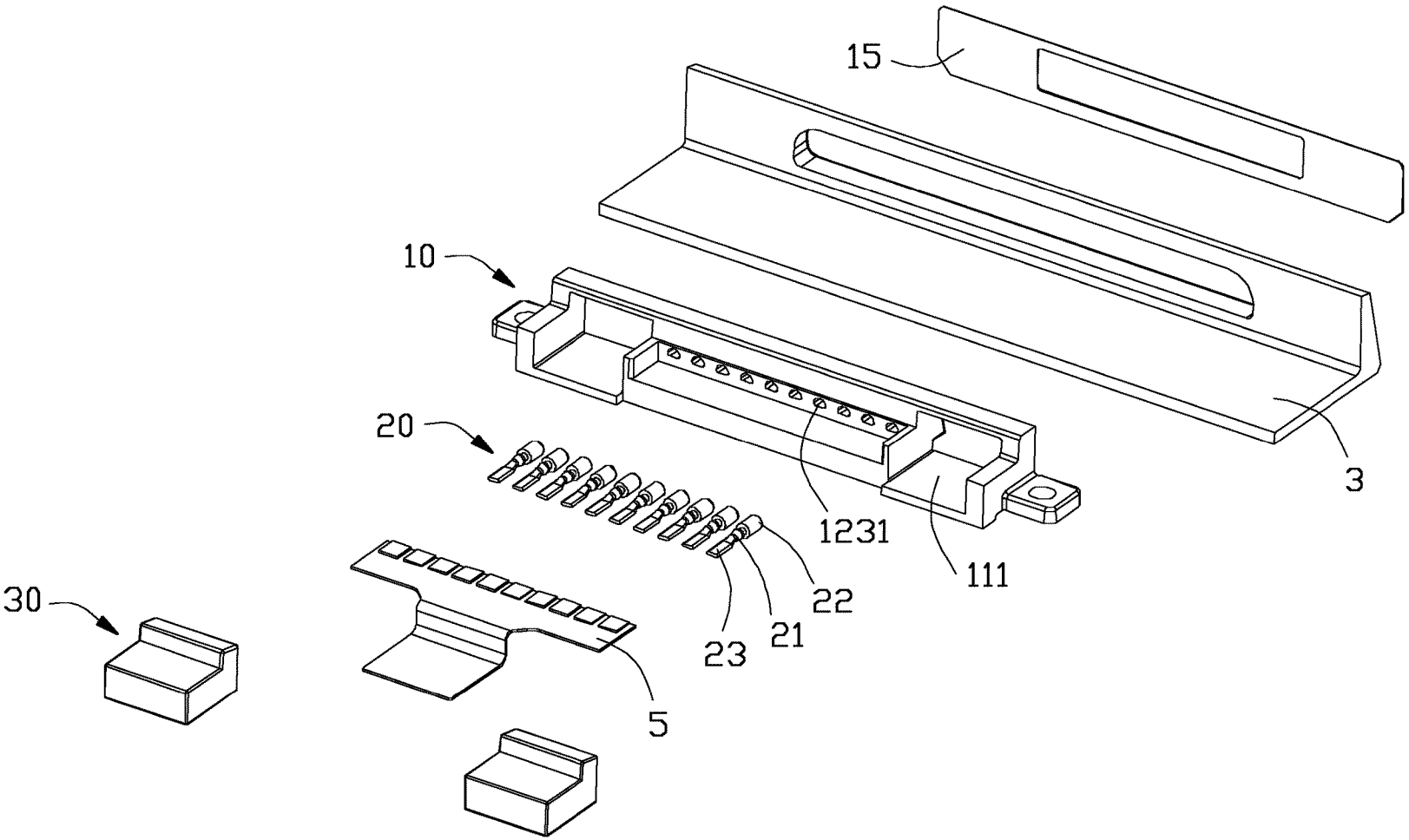
FIG. 4 is another exploded perspective view of the electrical connector shown in FIG. 3.

Referring to FIG. 3 and FIG. 4, the electrical connector 1 includes a longitudinal insulative seat 10, a plurality of terminals 20 fixed in the insulative seat 10 and a pair of magnets 30. The insulative seat 10 defines a first mating surface 110 and a mating portion 12 projecting forwardly from the first mating surface 110. The mating portion 12 defines a second mating surface 121 and a shallow recess 122 recessed from the second mating surface 121, the shallow recess 122 defines a third mating surface 1221 formed in an inner bottom surface thereof. The insulative seat 10 defines a plurality of terminal slots 123 running through the third mating surface 1221, which is used for receiving corresponding terminals in order to prevent the conductive terminals being damaged by external forces. The insulative seat 10 further defines a pair of retaining cavities 111 located on both sides of the mating portion 12 and running through the first mating surface 110 and the rear surface, the magnets 30 are closely received in the retaining cavities 111 and the front surface 31 of the magnet 30 is flush with the first mating surface 110, whereby the first mating surface 110 of the insulative seat 10 and the front surface 31 of the magnet 30 together form a mating surface of the electrical connector 1. The magnets 30 are located on both sides of the conductive terminals 20 so as to prevent the magnetic substance contacting the terminals when the magnetic substance is attracted to the device. The electrical connector 1 further defines a membrane 15 covering the mating surface 110 of the insulative seat 10 in order to prevent the insulative seat 10 from damaged and the magnets 30 when the electrical connector mated.

Figure 6:
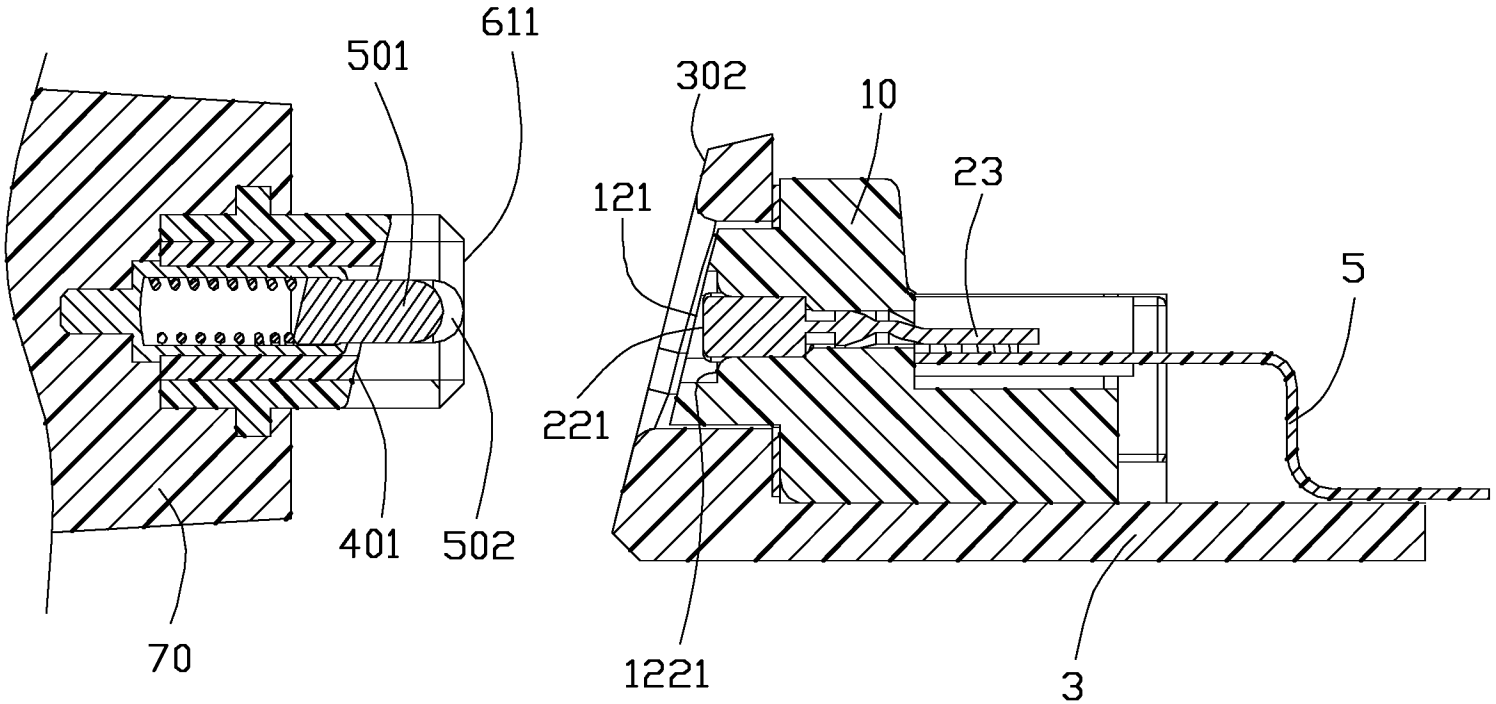
FIG. 6 is a cross-sectional perspective view of the magnetic connector assembly take along the line 6-6 shown in FIG. 1.

Referring to FIG. 1 and FIG. 6, each terminal 20 is a non-scalable terminal and defines a retaining portion 21 fixed in the insulative seat 10, a contacting portion 22 extending forwardly from the retaining portion 21 and a soldering portion 23 extending backwardly from the retaining portion 21. The contacting portion 21 defines a free end section 221 exposed within the shallow recess 121 of the mating portion 12, and the free end section 221 is located behind the second mating surface 121 while in front of the third mating surface 1221 so as to ensure better contacting effect of the terminals and avoid disconnection caused by the mating portion 12 of the insulative seat 10. The soldering portion 23 of the terminal 20 is extending outside of the insulative seat 10 from the terminal slot 123 and the soldering portion 23 is a flat shape by an eccentric extrusion process, which is conductive to the soldering between the terminals and the soldering plane of the flexible circuit board 5 of the device. While the rear side of the terminal slot 123 of the insulative seat 10 is disposed semicircular shape to form a semicircular terminals slot 1231, and the flat-shaped soldering portion 23 is accommodated in the semicircular terminals slot 1231, which effectively prevents the terminals rotating in the terminal slots 123. Moreover, the front surface 302 of the shell 3 and the second mating surface 121 are inclined, the third surface 1221 and the first surface are vertically disposed.

Figure 5:
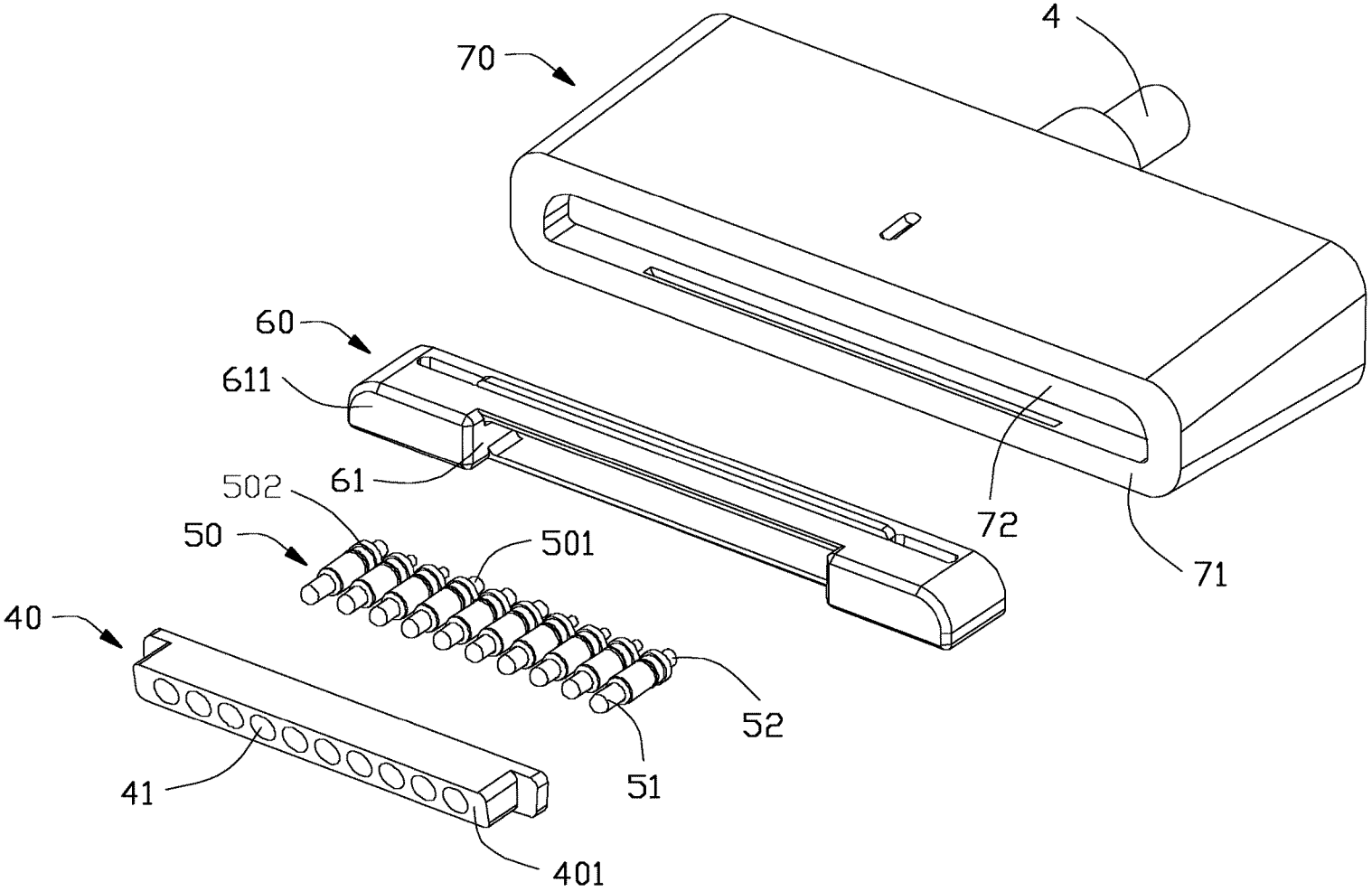
FIG. 5 is an exploded perspective view of a mating connector of the magnetic connector assembly shown in FIG. 2.

Referring to FIG. 5, the mating connector 2 is used for mating the electrical connector 1 and includes an insulative housing 40, a plurality of scalable terminals 50 fixed in the insulative housing 40, a magnetic element 60 and an insulative shell 70, wherein the magnetic element 60 is an integral structure and substantially rectangular shape. The insulative housing 40 defines a first engaging surface 401 and a plurality of terminal slots 41 running through the first engaging surface 401 and used for receiving the corresponding scalable terminals 50. Each scalable terminals 50 extends along a front-to-rear direction in the terminal slot 41 and defines a contacting end 51 projecting outside of the first engaging surface 401 of the insulative housing 40. The magnetic element 60 surrounds the outside of the insulating body 40 and defines a pair of protrusions 61 extending forwardly from both sides of the first engaging surface 401 of the insulative housing 40, the protrusion 61 is used for being received by the mating cavity 301 of the device. The front surface 71 of the insulative shell 70 is open to form a receiving space 72.

Referring to FIG. 6, the rear portions of the insulative housing 40 and the magnetic element 60 are received in the receiving space 72 of the insulative shell 70, and the front portion of the magnetic element 60 is projecting forwardly from the front surface 71 of the insulative shell 70 so that the protrusions 61 of the magnetic element 60 have a second engaging surface 611 to form a mating surface of the mating connector 2. In the preferred embodiment, the scalable terminals 50 of the mating connector 2 include a row of signal terminals 501 and a pair of grounding terminals 502 located both sides of signal terminals 501. In a free state, the front ends of the grounding terminals 502 are flush with the second engaging surface 611 and the front ends of the signal terminals 501 are retracted from the second engaging surface 611 of the protrusions 61, i.e., the front ends of the grounding terminals 502 are disposed in front of the front ends of the signal terminals 501.

When the electrical connector 1 is mated the mating connector 2, the grounding terminals 502 earlier than the signal terminals 501 of the mating connector 2 are contacting with terminals 20 of the electrical connector 1, thereby making the grounding terminals 502 can lead static electricity away before the signal terminals 501 contact with terminals 20 of the electrical connector 1, thus ensuring the security of the circuit system. Each scalable terminal 50 defines a connecting portion 52 protruding outside of the rear surface of the insulative housing 40 and connected to the conductive core wire of the cable 4. The second engaging surface 611 of the protrusions 61 is a vertical shape and the first engaging surface 411 of the insulative housing 40 is inclined, just to fit with the electrical connector.

The mating surface of the mating connector 2 includes having two opposite long sides 601, 602 and two opposite short sides 603, 604, the two short sides are connected to the two long sides and symmetrical to each other. One of the long sides 601 is connected to the two short sides to form a right angle respectively, and the other long side 602 is connected to the two short sides 603, 604 to form an arc chamfer, respectively. While the shell 3 of the device with the electrical connector 1 form a formation corresponding to the long sides and the short sides of the mating connector 2 so that the user can easily identify to prevent wrong insertion.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the board general meaning of the terms in which the appended claims are expressed.

What is claimed is:

1. An electrical connector, comprising:

an insulative seat defining a vertical first mating surface and a mating portion extending forwardly from the first mating surface along a front-to-back direction, the mating portion defining an inclined second mating surface;

a plurality of terminals fixed to the insulative seat and each defining a contacting portion disposed in the mating portion and a soldering portion extending outside of the insulative seat; and a pair of magnetic elements retained in the insulative seat by two sides of the mating portion in a transverse direction perpendicular to said front-to-back direction; and a shell located in front of the electrical connector and defining a receiving cavity in which said mating portion is disposed, the second mating surface being located behind a front face of the shell, the mating portion being intimately contacting the shell in a vertical direction perpendicular to both said front-to-back direction and said transverse direction while being spaced from the shell in the transverse direction to leave two opposite spaces which are located by two sides of the mating portion in the transverse direction and aligned with the corresponding magnetic elements in the front-to-back direction, respectively; wherein the mating portion defines a shallow recess recessed backwardly from the second mating surface, and the contacting portion defines a free end exposed in the shallow recess and locating behind the second mating surface.

2. The electrical connector as described in claim 1, wherein the shallow recess of the mating portion defines a vertical third mating surface, the insulative seat defines a plurality of the terminal slots running through the third mating surface for receiving the terminals, the rear portion of each terminal slot is semicircular shape to form a semicircular terminal slot, and the soldering portion of the terminal is slat shape to be received in the semicircular terminal slot.

3. The electrical connector as described in claim 1, wherein the insulative seat defines a pair of retaining cavities located on both sides of the mating portion and running through the first mating surface, the magnetic elements are located on both sides of the terminals and closely accommodated in the pair of retaining cavities.

4. The electrical connector as described in claim 3, wherein the first mating surface of the insulative seat is flush with the front surface of the magnetic elements so that the first mating surface of the insulative seat and the front surface of the magnetic elements together form a mating surface of the electrical connector.

5. The electrical connector as described in claim 1, wherein the electrical connector defines a membrane covering the mating surface of the insulative seat in order to prevent the insulative seat and the magnetic elements from damaged when the electrical connector mated.

6. The electrical connector as described in claim 1, wherein the electrical connector is mounted on a shell of a device with an opening, the first mating surface of the electrical connector and the opening of the shell together form a mating cavity for receiving a mating connector.

7. A magnetic connector assembly, comprising:

an electrical connector including an insulative seat and a plurality of terminals fixed to the insulative seat, the insulative seat defining a vertical first mating surface and a mating portion extending forwardly from the first mating surface along a front-to-back direction, the mating portion defining an inclined second mating surface and a shallow recess recessed from the second mating surface; and a shell located in front of the first electrical connector and defining a receiving cavity in which said mating portion is disposed, the second mating surface being located behind a front face of the shell, the mating portion being intimately contacting the shell in a vertical direction perpendicular to said front-to-back direction;

a mating connector including an insulative housing and a plurality of scalable terminals fixed in the insulative housing, the insulative housing defining an inclined first engaging surface, each scalable terminal defining a contacting end projecting outside of the first engaging surface of the insulative housing; wherein when the electrical connector is engaging with the mating connector, the second mating surface of the electrical connector is fitly engaging with the first engaging surface of the mating connector, and the scalable terminals of the mating connector are received in the shallow recess and engaging with the terminals of the electrical connector.

8. The magnetic connector assembly as described in claim 7, wherein the shallow recess of the mating portion defines a vertical third mating surface, the insulative seat defines a plurality of the terminal slots running through the third mating surface and each terminal of the electrical connector defines a contacting portion disposed in the corresponding terminal slot and a soldering portion extending outside of the insulative seat, the contacting portion defines a free end exposed on the shallow recess which locates behind the second mating surface.

9. The magnetic connector assembly as described in claim 8, wherein the rear portion of each terminal slot is semicircular shape to form a semicircular terminal slot, and the soldering portion of the terminal is slat shape to be received in the semicircular terminal slot.

10. The magnetic connector assembly as described in claim 7, wherein the insulative seat defines a pair of retaining cavities located on both sides of the mating portion and running through the first mating surface, the electrical connector defines a pair of magnetic elements located on both sides of the terminals and closely accommodated in the pair of retaining cavities.

11. The magnetic connector assembly as described in claim 8, wherein the front surfaces of the magnetic elements are flush with the first mating surface of the insulative seat so that the first mating surface of the insulative seat and the front surface of the magnetic elements together form a mating surface of the electrical connector.

12. The magnetic connector assembly as described in claim 11, wherein the mating connector defines a magnetic element surrounding outer of the insulative housing, the magnetic element defines a pair of protrusions disposed on both sides of the insulative housing and the protrusions have a second engaging surface engaging with the mating surface of the electrical connector.

13. The magnetic connector assembly as described in claim 12, wherein the scalable terminals of the mating connector include a row of signal terminals and a pair of grounding terminals located both sides of signal terminals, the front ends of the grounding terminals are flush with the second engaging surface of the protrusions and the front ends of the grounding terminals are disposed in front of the front ends of the signal terminals.

14. A magnetic connector assembly comprising:

a first electrical connector and a second electrical connector adapted to be mated with each other, said first electrical connector including:

a first insulative seat defining a first mating surface, a mating portion forwardly extending beyond the first mating surface along the front-to-back direction, a second mating face formed on a front end face of the mating portion;

a plurality of first terminal slots arranged in the first insulative seat with one another along a transverse direction perpendicular to the front-to-back direction, each of said first terminal slots extending forwardly through the second mating surface;

a plurality of first terminals disposed in the corresponding first terminal slots, respectively, each of said first terminals including a first front contacting portion with a first free end section located behind the second mating surface;

a pair of retaining cavities formed within the first insulative housing by two sides of the mating portion in the transverse direction;

a pair of first magnetic attraction elements disposed within the corresponding retaining cavities, respectively;

a shell located in front of the first electrical connector and defining a receiving cavity in which said mating portion is disposed, the second mating surface being located behind a front face of the shell, the mating portion being intimately contacting the shell in a vertical direction perpendicular to both said front-to-back direction and said transverse direction while being spaced from the shell in the transverse direction to leave two opposite spaces which are located by two sides of the mating portion in the transverse direction and aligned with the corresponding first magnetic attraction elements in the front-to-back direction, respectively;

the second electrical connector including:

a second insulative housing defining therein a plurality of second terminal slots with one another in the transverse direction, each of said second terminal slots extending along the front-to-back direction;

a plurality of second terminals disposed within the corresponding second terminal slots, respectively, each of said second terminals forming a second front contacting portion exposed forwardly beyond a front face of the housing and being retractable along the front-to-back direction; and a pair of second magnetic attraction elements located by two sides of the second front ends of said second terminals in the transverse direction; wherein said pair of second magnetic attraction elements extend into the two spaces in the receiving cavity and intimately contact the corresponding first magnetic attraction elements in the front-to-back direction, respectively.

15. The magnetic connector assembly as claimed in claim 14, wherein the pair of second magnetic attraction elements defines an asymmetrical structure with regard to the transverse direction to comply with the receiving cavity so as to assure only one orientation of said second connector to be coupled with the first connector through said receiving cavity.

16. The magnetic connector assembly as claimed in claim 14, wherein before mating, the second front contacting portions of the second terminals are exposed to an exterior in the vertical direction while are protectively hidden behind the pair of second magnetic attraction elements in the transverse direction.

17. The magnetic connector assembly as claimed in claim 14, wherein the first insulative housing forms a shallow recess inwardly and rearwardly recessed from the second mating surface, and the first free end section is exposed within the shallow recess.

18. The magnetic connector assembly as claimed in claim 14, wherein said second mating surface is oblique, and the front face of the shell is oblique in compliance with said second mating surface.

19. The magnetic connector assembly as claimed in claim 18, wherein said second insulative housing defines an engagement surface which is oblique in compliance with the second mating surface.

* * * * *